US010358336B2

(12) United States Patent
Kasper et al.

(10) Patent No.: US 10,358,336 B2
(45) Date of Patent: Jul. 23, 2019

(54) LUBRICANT DISPENSING SYSTEM

(71) Applicants: Joseph A. Kasper, Lexington, KY (US); Steven B. Ruble, Lexington, KY (US); Keith Peshke, Lexington, KY (US); Mark Gandy, Brooklyn, KY (US); Phillip D Shook, Brooklyn, NY (US)

(72) Inventors: Joseph A. Kasper, Lexington, KY (US); Steven B. Ruble, Lexington, KY (US); Keith Peshke, Lexington, KY (US); Mark Gandy, Brooklyn, KY (US); Phillip D Shook, Brooklyn, NY (US)

( * ) Notice: Subject to any disclaimer, the term of this patent is extended or adjusted under 35 U.S.C. 154(b) by 0 days.

(21) Appl. No.: 15/219,488

(22) Filed: Jul. 26, 2016

(65) Prior Publication Data

US 2018/0370787 A1 Dec. 27, 2018

(51) Int. Cl.

| | |
|---|---|
| ***B67D 7/04*** | (2010.01) |
| ***B67D 7/84*** | (2010.01) |
| *B67D 7/00* | (2010.01) |

(52) U.S. Cl.

CPC ..... *B67D 7/04* (2013.01); *B67D 7/84* (2013.01); *B67D 7/005* (2013.01)

(58) Field of Classification Search

CPC ..... B67D 7/04; B67D 7/005
USPC ..... 141/363–366
See application file for complete search history.

(56) References Cited

U.S. PATENT DOCUMENTS

| | | | | | |
|---|---|---|---|---|---|
| 862,999 | A * | 8/1907 | Satterlee | B67D 1/16 | 222/108 |
| 2,162,625 | A * | 6/1939 | Lowe | B67D 7/58 | 222/130 |
| 4,881,652 | A * | 11/1989 | Schiemann | B65D 1/14 | 220/23.8 |
| 4,919,301 | A * | 4/1990 | Miller | B67D 7/0288 | 137/581 |
| 5,285,989 | A * | 2/1994 | Zilbert | B67D 1/16 | 141/311 A |
| 5,503,246 | A * | 4/1996 | Raboin | B65D 25/00 | 141/98 |
| 5,597,097 | A * | 1/1997 | Morris | B65D 25/38 | 222/529 |
| 6,189,720 | B1 * | 2/2001 | Gillispie | B65D 90/24 | 141/311 A |
| 6,260,589 | B1 * | 7/2001 | Zeppieri | B67D 1/0842 | 141/106 |
| 9,738,441 | B2 * | 8/2017 | LeBlanc | B65D 90/12 | |
| 2008/0000863 | A1 * | 1/2008 | DiBello | A47B 61/00 | 211/134 |
| 2008/0277417 | A1 * | 11/2008 | Groesbeck | B65D 5/4204 | 222/105 |
| 2011/0036864 | A1 * | 2/2011 | McKenna | B65D 77/065 | 222/105 |
| 2011/0266287 | A1 * | 11/2011 | Groesbeck | B65D 5/4204 | 220/592.01 |

(Continued)

*Primary Examiner* — Timothy L Maust
(74) *Attorney, Agent, or Firm* — Francis Law Firm, PLLC; James M. Francis

(57) ABSTRACT

A lubricant dispensing system employing configurable shelving that aligns a lubricant dispenser's spigot directly above a fill port of a lubricant dispensing jug. The shelving system units are configurable to accommodate the available space in a garage, designed for use with lubricant bag boxes, and possesses a spill catch below the jug.

11 Claims, 8 Drawing Sheets

(56) References Cited

U.S. PATENT DOCUMENTS

| | | | | |
|---|---|---|---|---|
| 2013/0233858 | A1* | 9/2013 | Elberg | A47G 19/2222 220/504 |
| 2014/0230960 | A1* | 8/2014 | Ciavarella | B65B 3/045 141/83 |
| 2015/0075964 | A1* | 3/2015 | Kamen | B01D 1/0082 202/180 |
| 2017/0362007 | A1* | 12/2017 | Kirchmeyer | B65D 77/24 |
| 2018/0178941 | A1* | 6/2018 | Kasper | B65D 5/4204 |
| 2018/0213948 | A1* | 8/2018 | Amacher, Jr. | A47F 7/288 |

* cited by examiner

Fig. 3
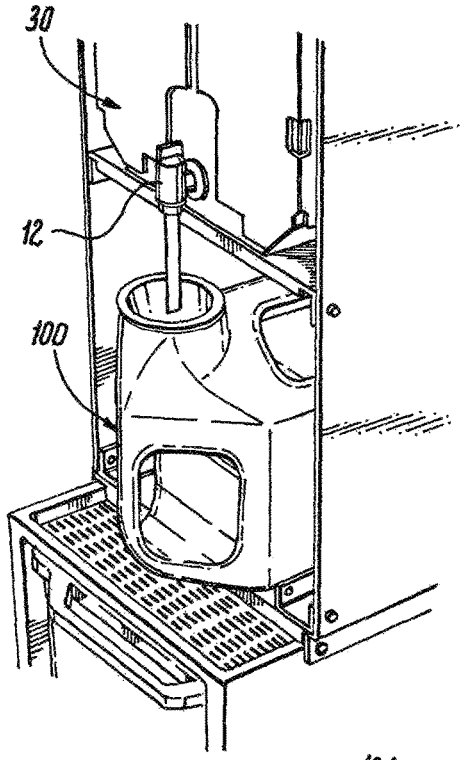
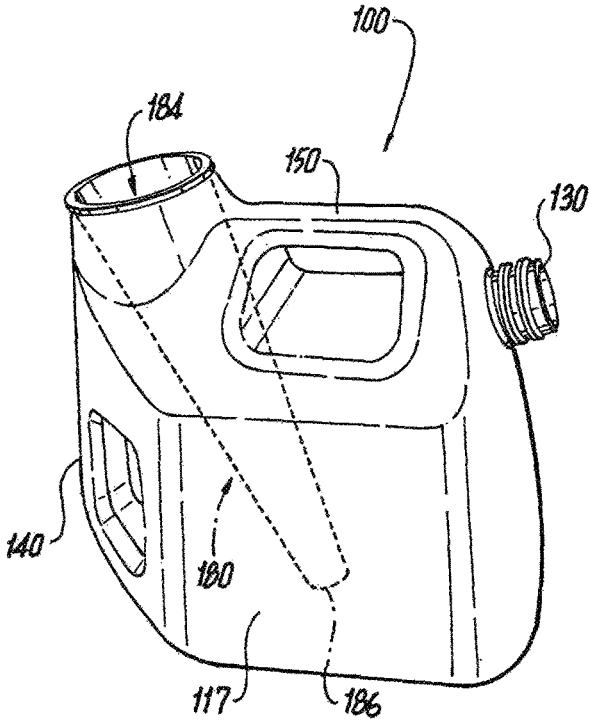
Fig. 4
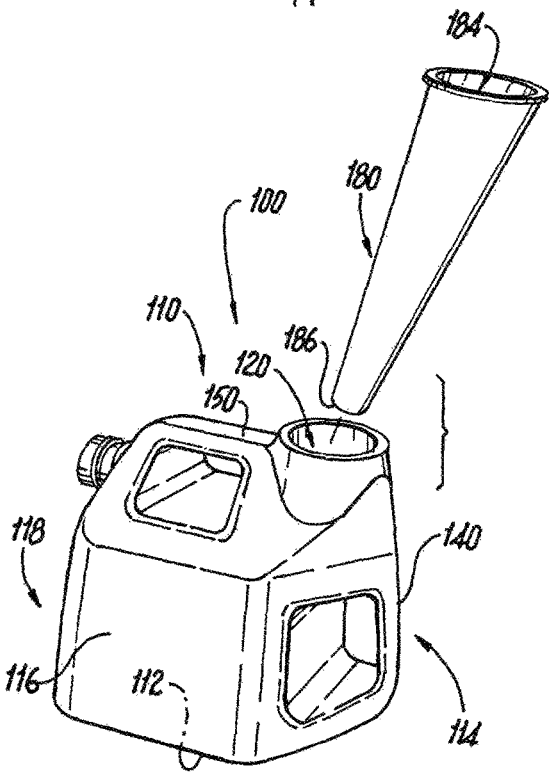
Fig. 5

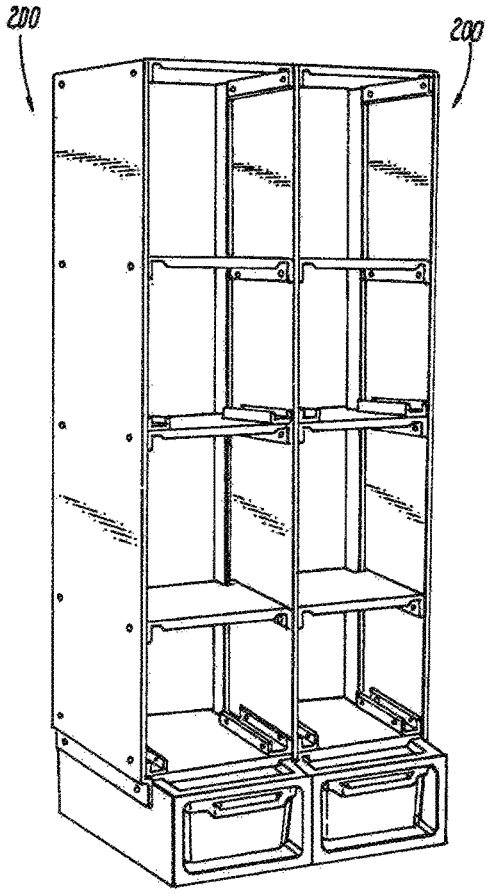
Fig. 11C
Fig. 11D
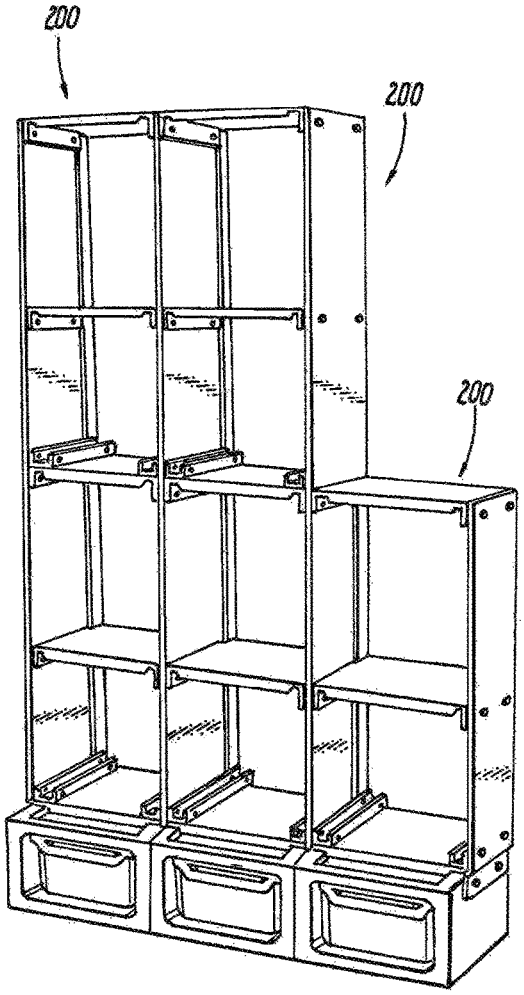

LUBRICANT DISPENSING SYSTEM

CROSS REFERENCE TO RELATED APPLICATIONS

This application claims priority from U.S. Provisional Application 62/239,324 filed Oct. 9, 2015 and entitled Lubricant Dispensing System.

TECHNICAL FIELD

The system of the present application relates generally to dispensing systems. More specifically, the device of the present application relates to a configurable liquid dispensing system.

SUMMARY

The present application discloses a lubricant bag box dispensing system which utilizes a lubricant bag having an integrated spigot at its base. The lubricant bag is housed within a chamfered bag housing having a spigot port through which the lubricant bag's spigot passes. The bag housing further possesses a vertical sight and hand ports which are used as handles.

An ergonomic lubricant dispensing jug is also disclosed. The jug possesses a wide base to lower the center of gravity and lubricant fill port at the rear of the jug. A fill port containment wall extends vertically from the boundary of the fill port and acts to further minimize the chance for spillage and splashing. A removably attached funnel is nested on the jug spout.

A modular rack system is disclosed that houses the lubricant bag box above the ergonomic lubricant dispensing jug. The modular rack system also serves to align the spout of the lubricant bag box above the lubricant dispensing jug's fill port for spill free filling.

BRIEF DESCRIPTION OF THE DRAWINGS

FIG. 3 depicts an embodiment of a modular rack system.

FIG. 4 depicts a perspective view of an ergonomic lubricant jug and stored funnel.

FIG. 5 depicts a perspective view of an ergonomic lubricant jug and funnel.

FIG. 11C depicts a front-left perspective view of an assembly of shelving module units with drain pans.

FIG. 11D depicts a front-right perspective view of an assembly of shelving module units with drain pans.

DETAILED DESCRIPTION OF THE PREFERRED EMBODIMENTS

The present application describes various embodiments of a lubricant bay box dispensing system.

Figure 1:
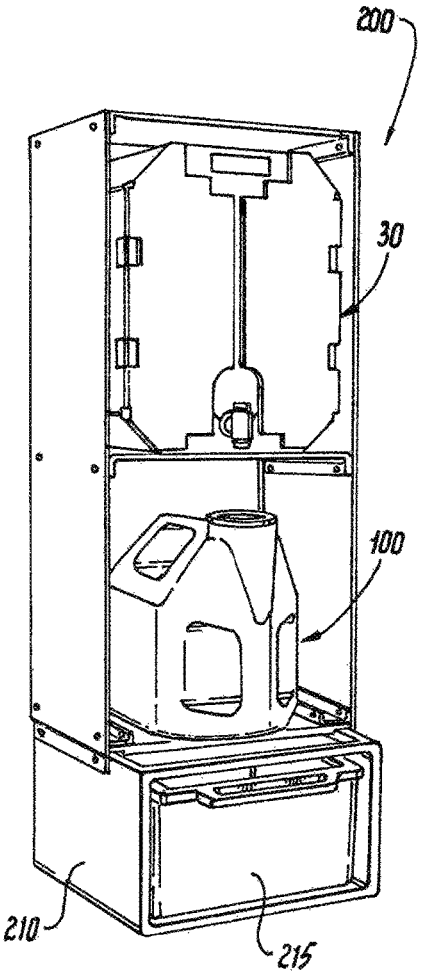
FIG. 1 depicts an embodiment of the lubricant bay box system assembly.

As depicted in FIG. 1, lubricant 1 is stored within and ultimately dispensed from a sealed flexible reservoir bag 10. The reservoir bag 10 preferably possesses a reservoir bag base 14, proximal face 15, distal face 16, top 17, first side face 18, and second side face 19. The reservoir bag 10 is preferably made from a high density polymer to form a puncture resistant carrier and possesses dispenser 12, e.g. a spigot assembly 12 or functionally similar means to control the dispensing of lubricant from the reservoir bag base 14 via a gravity feed.

Figure 2:
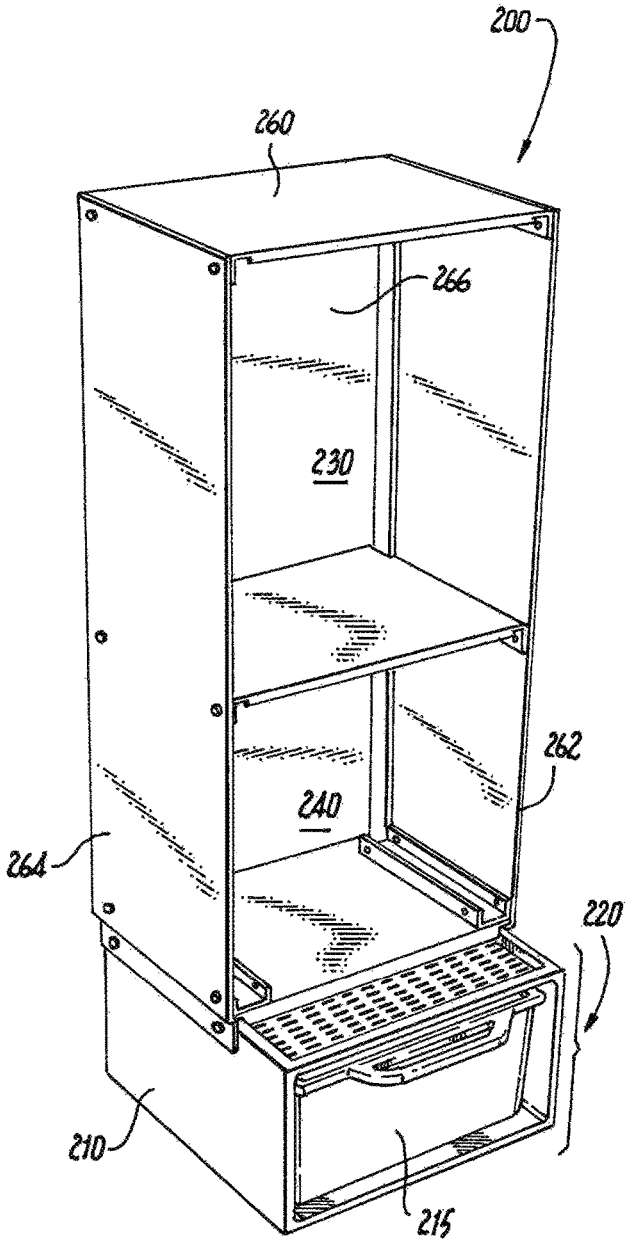
FIG. 2 depicts an embodiment of a modular rack system.
Figure 6:
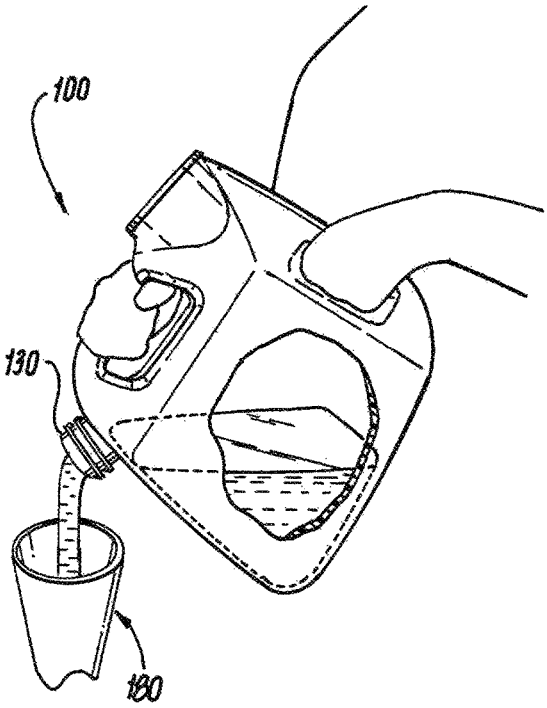
FIG. 6 depicts a perspective view of a lubricant filled ergonomic lubricant jug in use with a funnel.
Figure 7:
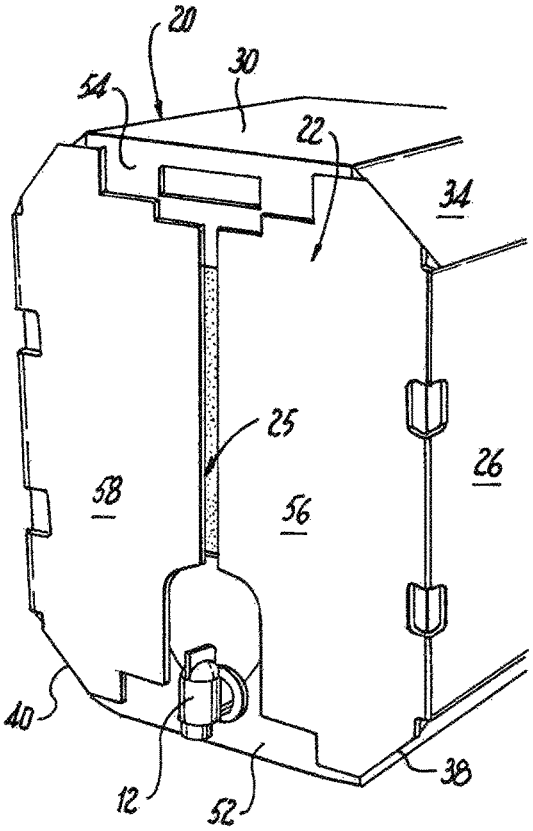
FIG. 7 depicts a cutaway front plan view of a bag housing a lubricant filled bag.
Figure 8:
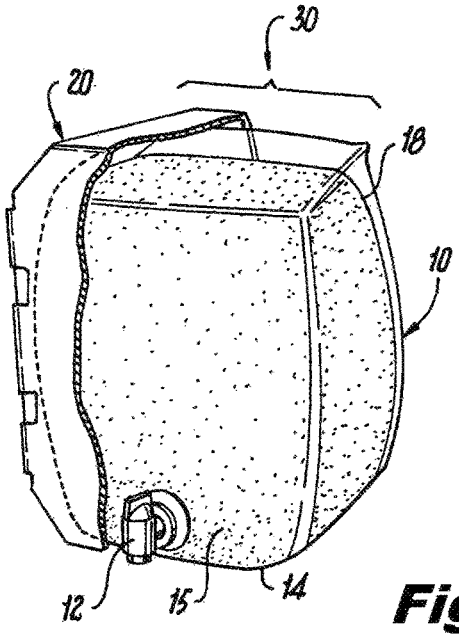
FIG. 8 depicts a perspective cutaway view of a bag housing a lubricant filled bag.
Figure 9:
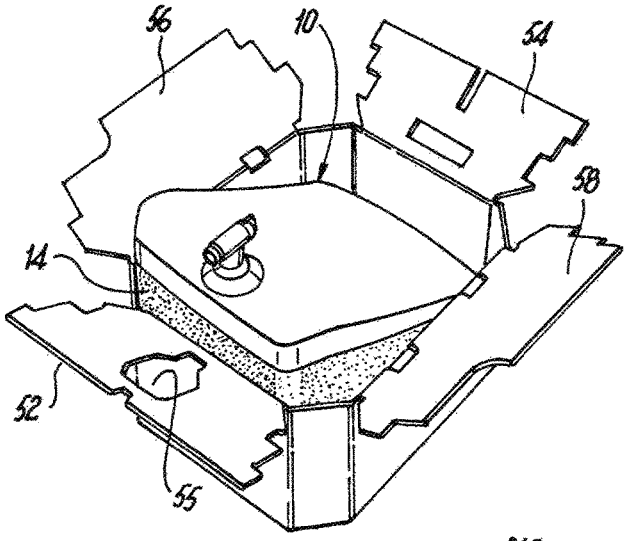
FIG. 9 depicts a perspective view of an unassembled bag box and lubricant bag.
Figure 10:
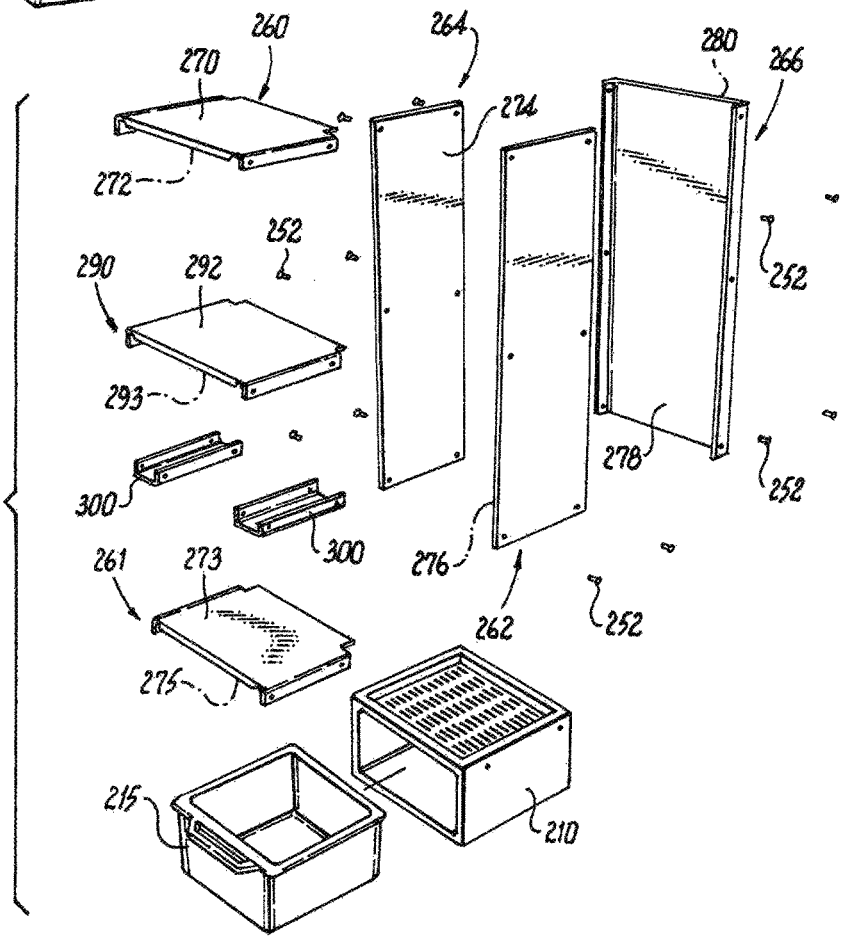
FIG. 10 depicts an exploded view of a shelving module and drain pan module.
Figure 11A:
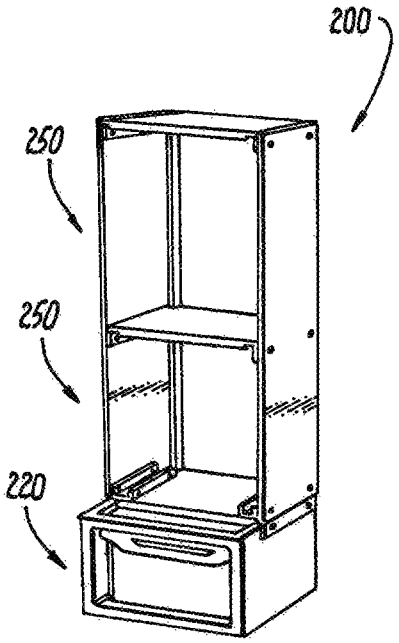
FIG. 11A depicts a front-right perspective view of an assembled shelving module unit and drain pan.
Figure 11B:
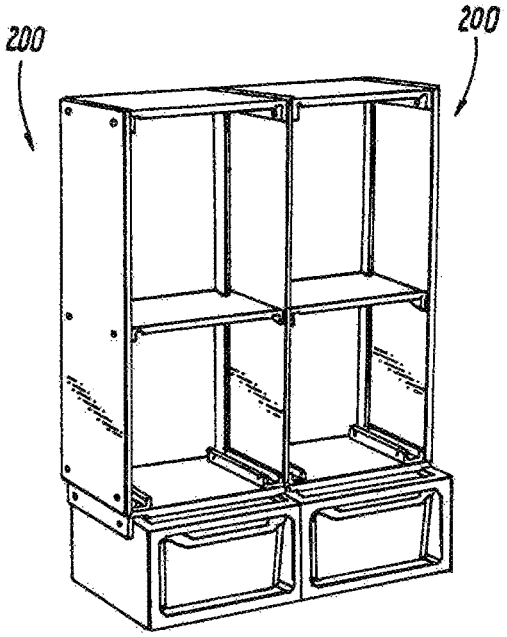
FIG. 11B depicts a front-left perspective view of an assembly of two laterally installed shelving module units and drain pans.
Figure 12:
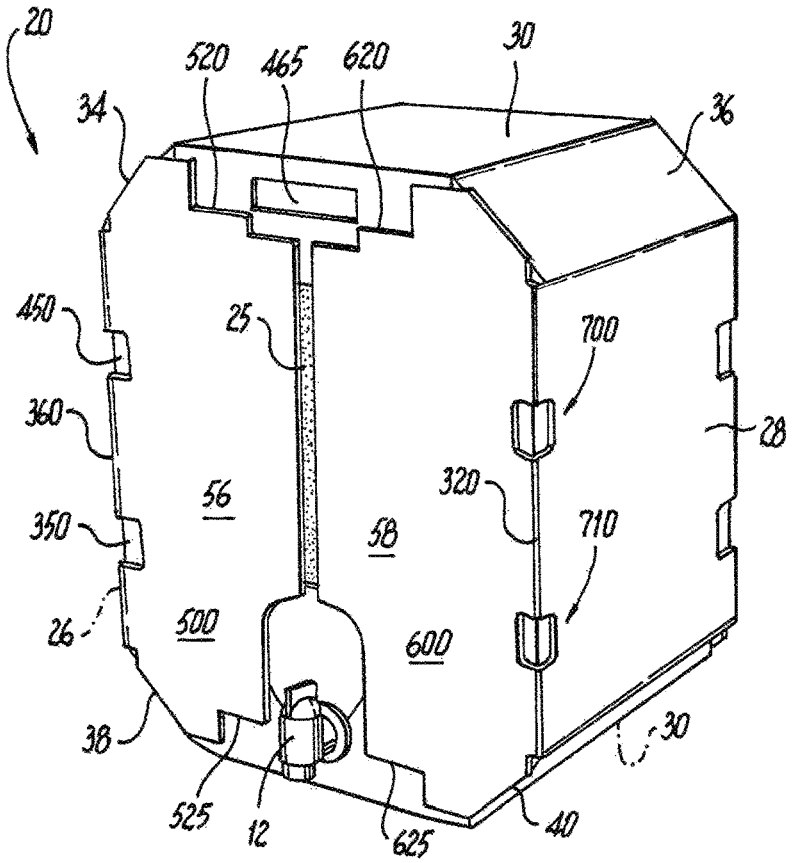
FIG. 12 depicts a perspective view of a lubricant filled box for use with the rack system.
Figure 13:
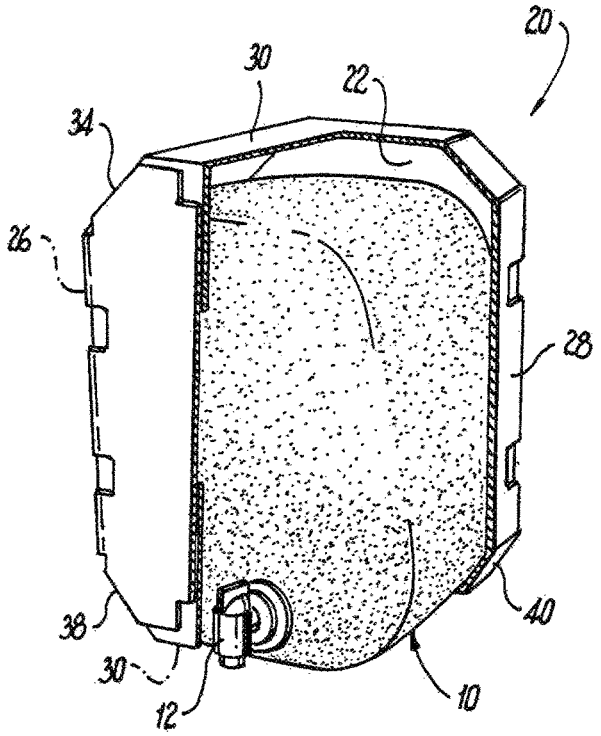
FIG. 13 depicts a cutaway perspective view of a lubricant filled box for use with the modular rack system.
Figure 14:
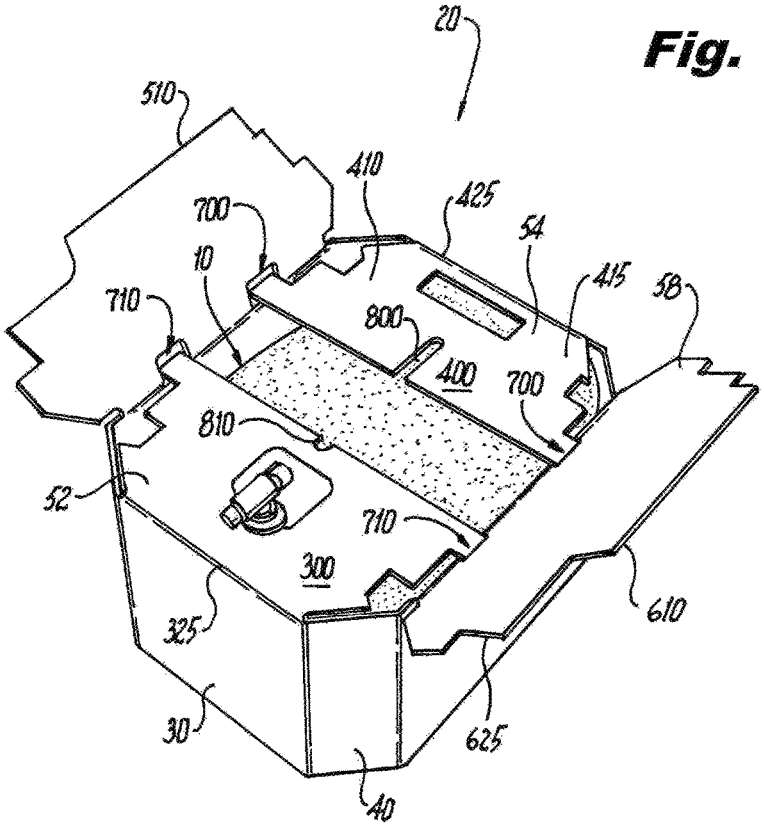
FIG. 14 depicts a perspective view of a partially assembled lubricant bag containing box for use with the modular rack system.
Figure 15:
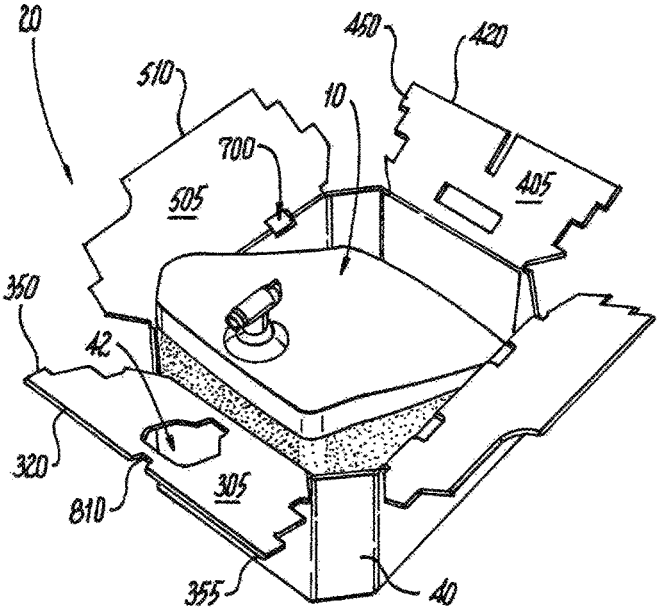
FIG. 15 depicts a perspective view of a partially assembled lubricant bag containing box for use with the modular rack system.

The lubricant filled reservoir bag 10 is contained within a bag housing 20 as depicted in FIG. 2. The combination of the assembled reservoir bag 10 and reservoir bag housing 20 is referred to herein as the bag box 30.

A bag housing 20 is preferably constructed of cardboard and is sufficiently rigid to contain and protect a lubricant filled reservoir bag 10 housed therein. The assembled bag housing 20 is a preferably a box having a proximal wall 22, a distal wall 24, a first lateral wall 26, a second lateral wall 28, a top wall 30, a base wall 32, a first top chamfered wall 34, a second top chamfered wall 36, a first base chamfered wall 38, and a second base chamfered wall 40. A spigot port 42 at the base of the proximal wall 22 allows the bag's integrated spigot 12 to be pulled through the proximal wall 22 so as to allow the spigot 12 reside outside of the reservoir bag housing 20 while the reservoir bag 10 is housed within the bag housing 20. The chamfered walls 34, 36, 38, 40 add structural strength to the bag housing 20. Moreover, the first and second base chamfered walls 38,40 decrease the available space for the lubricant filled bag at the bottom of the bag housing 20, thereby increasing pressure and improving flow through the spigot 12.

The bag housing 20 preferably has four proximal flaps 50 that fold together to create the proximal wall 22, i.e. a proximal base flap 52, a proximal top flap 54, a first proximal lateral flap 56, and a second proximal lateral flap 58. The proximal base flap 52 possesses a spigot flap orifice 55 through which a spigot 12 may pass. Ideally, the bag housing 20 possesses a vertical bag sight port 25 to permit the volume of lubricant 1 remaining in the bag to be readily ascertained. The sight port 25 is created from a gap left between the proximal flaps 50 when they are folded together.

An ergonomic lubricant dispensing jug 100 is utilized to receive the lubricant 1 from the bag box 30 and to transport it to a lubrication point, e.g. an engine being serviced. The lubricant dispensing jug 100 preferably possesses a top 110, base 112, proximal side 114, distal side 116, a first lateral side 117, and a second lateral side 118. A lubricant fill inlet 120 is sited at the top of the jug 100 along its proximal side 114. The lubricant fill inlet 120 is used to fill the lubricant dispensing jug, i.e. jug, with a lubricant 1. The lubricant 1 is intended to flow into the lubricant fill inlet 120 when the jug 100 is placed below the bag box 30 and the spigot 12 is vertically aligned with the lubricant fill inlet 120. The jug 100 preferably possesses a first jug handle 140 along its proximal side 114 in the jug's proximal-distal plane. In an alternative embodiment, a second jug handle 150 runs along the top of the jug 100 parallel to the horizontal axis extending from the distal side 116 to the proximal side 114 and in line with a plane extending from the jug top 110 to the jug base 112. The first jug handle 140 is ergonomically positioned substantially in the center of the distal side 116 of the jug and above the jug base 112 so as to typically keep the center of gravity of the lubricant filled jug 100 below the user's hand. The jug 100 further possesses a removable funnel 180 having a funnel inlet 184 that possesses a larger diameter than the lubricant fill inlet 120, and a funnel outlet 186 having a smaller diameter than both the lubricant fill inlet 120 and the funnel inlet 184. The funnel 180 is typically stored within the jug 100 with the funnel outlet 186 housed within the jug 100 by inserting the funnel outlet into the jug 100 through the lubricant fill inlet 120. The passage of the funnel inlet 184 into the jug 100 is stopped by the neck of the lubricant fill inlet 120 as it is of a smaller diameter than the funnel inlet 184. The jug 100 is preferably emptied through the jug outlet 130.

A modular rack 200 is provided for the storage of a bag housing 30, a dispensing jug 100, and a spill containment module 220. The modular shelving rack 200 is constructed from a rigid material, preferably a metal or alloy. Each shelving module 250 of the modular rack 200 is a substantially hollow rectangular boxed frame having a top module wall 260, a base module wall 261 a first lateral module wall 262, a second lateral module wall 264, and a distal module wall 266 affixed by wall fastening means 222. The top module wall 260 possesses an outer top module wall face 270 and an inner top module wall face 272. The base module wall 261 possesses an base wall inner surface 273 and a base wall outer surface 275. Each lateral wall 262, 264 possesses a lateral wall inner surface 274 and a lateral wall outer surface 276. The distal wall 266 possesses a distal wall inner surface 278 and a distal wall outer surface 280. A module shelf 290 having a module shelf top surface 292 and a module shelf bottom surface 293 is affixed between the lateral walls 262, 264 to segregate each module into a top storage compartment 230 and a bottom storage compartment 240. The top storage compartment 230 is used to store a bag box 30. The bottom storage compartment 240 is used to store a jug 100. The shelving module 250 preferably lacks a connecting wall across the proximal side of the frame 255.

The top storage compartment 230, in a preferred embodiment, is of sufficient width to permit the insertion of a bag box 30, i.e. lubricant storage container 30, and not wide enough to permit the bag box 30 to move laterally enough to cause a misalignment between the bag box spigot 12 and the lubricant inlet port 120. The bottom storage compartment 240, in a further preferred embodiment, is the same width as the top storage compartment 230 but wider than the jug 100, therefore requiring the base module wall 261 to utilize a means to laterally align the jug 300, i.e. lubricant dispensing jug guide 300, beneath the bag box 30 by guiding the lateral sides of the jug 100 into the proper position. Ideally, the jug 100 possesses a depth from proximal to distal ends so as to allow the lubricant inlet port 120 to be correctly aligned with the spigot 12 along a pour proximal-distal axis when the jug 100 is fulling inserted into the bottom storage compartment 240. A screened drain pan module 210 with removable drain pan 215 is positioned beneath the module base wall 261 and an inserted jug so as to catch spills.

The shelving modules 250 may be coupled together in a vertically stacked manner and affixed to each other by a shelving module fastening means 252 (e.g. bolts, rivets, etc.) which functions to secure the top module wall 260 to the base module wall 261 of two shelving modules 250 stacked atop each other. Likewise, shelving modules 250 may be affixed horizontally across their lateral walls 262, 264. In a still further embodiment, the fastening means 252 may be removed to permit disassembly. The coupling of modules 250 permits the construction of a modular rack 200 that is configurable vertically and horizontally as needed to meet space requirements and restraints.

The top storage compartment 230 creates a housing which permits the shelving of a bag box 30 within the space defined by the confines of the inner surfaces 274, 276 of the lateral walls 262, 264 of both modules, the inferior surface 272 of the top module wall 260 of and the superior surface 292 of the module shelf 290.

The shelving modules 250 may be vertically coupled so that the outer surface 275 of the base module wall 261 of a top mounted module 250 is adjacent to the outer surface 270 of the top module wall 260 of a bottom mounted module 250. Likewise, shelving modules 250 may be horizontally coupled by affixing the outer surfaces 276 of the lateral walls 262, 264.

In a preferred arrangement, the bag box 30 is arranged above a jug 100 so that the bag box 30 may be drained into the dispensing jug 100 shelved immediately below the bag box 30. When the bag box 30 is placed into the top storage compartment 230 and seated against the inner surface 278 of the distal module wall 266 and the jug 100 is also seated against the inner surface 278 of the distal module wall 266, the bag box spigot 120 is aligned directly above and in close proximity to the lubricant fill inlet 120 on the jug 100.

While the system and processes of the present application have been particularly shown and described with reference to specific embodiments thereof, it will be understood by those skilled in the art that changes in the form and details of the disclosed embodiments may be made without departing from the spirit or scope of the application. In addition, although various advantages, aspects, and objects of the device system and processes of the present application have been discussed herein with reference to various embodiments, it will be understood that the scope of the application should not be limited by reference to such advantages, aspects, and objects. Rather, the scope of the application should be determined with reference to the appended claims.

What is claimed is:

1. A lubricant storage and dispensing system comprising:

a. a lubricant dispensing jug having a lubricant inlet port, a lubricant outlet port; a distal side, a proximal side, and at least one handle;

b. a lubricant storage container having a dispenser;

c. a shelving module for housing said lubricant dispensing jug below said lubricant storage container, said shelving module having a module distal wall possessing an inner surface and an outer surface, a first module lateral wall possessing an inner surface and an outer surface, a second module lateral wall possessing an inner surface and an outer surface, a module top wall possessing an inner surface and an outer surface, a module base wall possessing an inner surface and an outer surface, and a module shelf possessing a top surface and a bottom surface, said module shelf dividing said shelving module into a top storage compartment and a bottom storage compartment, wherein said lubricant dispensing jug is housed within said bottom storage compartment and said lubricant inlet port of said lubricant storage jug inlet port is aligned below said dispenser of said lubricant storage container when said lubricant dispensing jug is inserted into said bottom storage compartment and physically guided into position within said bottom storage compartment by at least one lubricant dispensing jug guide so as to cause the alignment of said inlet port of said lubricant dispensing jug and said dispenser of said lubricant storage container, and wherein said lubricant storage container is housed within said top storage compartment and said dispenser is aligned with said lubricant inlet port of said lubricant storage jug inlet port by at least one lubricant storage container guide so as to cause the alignment of said dispenser and said inlet port.

2. The lubricant storage and dispensing system of claim 1, wherein said dispenser is a spigot.

3. The lubricant storage and dispensing system of claim 1, wherein said at least one handle on said lubricant dispensing jug is arranged parallel to the top-base axis of said lubricant dispensing jug and aligned along the proximal-distal plane passing through said top-base axis.

4. The lubricant storage and dispensing system of claim 3, wherein said at least one handle's interior is hollow and in connection with the hollow space of said lubrication dispensing jug.

5. The lubricant storage and dispensing system of claim 1, wherein said at least one handle is configured to permit the user's hand to pass through a hand orifice passing through the body of said lubricant dispensing jug.

6. The lubricant storage and dispensing system of claim 1, wherein said at least one lubricant dispensing jug guide is affixed to said inner surface of said bottom storage compartment and said at least one lubricant storage container guide is affixed to said inner surface of said top storage compartment.

7. The lubricant storage and dispensing system of claim 3, wherein said lubricant storage container has a smaller width than the width of said top storage compartment so as to permit said lubricant storage container's insertion into said top storage compartment but also having sufficient width as to inhibit lateral movement of said lubricant storage container within said top storage compartment so that said lubricant storage container dispenser is aligned above said lubricant inlet port of said lubricant dispensing jug.

8. The lubricant storage and dispensing system of claim 1, further comprising a drain pan module below said shelving module and adjacent to said outer surface of said module base wall.

9. The lubricant storage and dispensing system of claim 8, wherein said drain pan module extends proximally beneath said lubricant dispensing jug and beyond said module base wall, wherein said drain pan module possesses a removable drain pan.

10. The lubricant storage and dispensing system of claim 5, wherein said dispenser of said lubricant storage container is aligned above said lubricant inlet port of said lubricant dispensing jug so as to allow lubricant to flow from said lubricant storage container dispenser into said lubricant inlet port of said lubricant dispensing jug.

11. The lubricant storage and dispensing system of claim 9, wherein said shelving module is affixed to at least one other shelving module by a shelving module fastening means.

* * * * *